United States Patent [19]

Bellafiore

[11] Patent Number: 4,471,490

[45] Date of Patent: Sep. 11, 1984

[54] HEARING AID

[76] Inventor: Gaspare Bellafiore, 58 Stevens Rd., Cranston, R.I. 02910

[21] Appl. No.: 467,134

[22] Filed: Feb. 16, 1983

[51] Int. Cl.[3] ..... H04R 25/02

[52] U.S. Cl. ..... 381/69; 179/107 E

[58] Field of Search ..... 179/107 E, 107 R, 182 R; 381/69

[56] References Cited

U.S. PATENT DOCUMENTS

| | | | |
|---|---|---|---|
| Re. 26,174 | 3/1967 | Leale | 179/107 E |
| 2,950,357 | 8/1960 | Mitchell | 179/107 E |
| 2,987,584 | 6/1961 | Webber et al. | 179/107 E |
| 4,069,400 | 1/1978 | Johanson | 179/107 E |

FOREIGN PATENT DOCUMENTS

| | | | |
|---|---|---|---|
| 2306670 | 11/1976 | France | 179/107 E |
| 1173657 | 12/1969 | United Kingdom | 179/107 E |
| 1179692 | 1/1970 | United Kingdom | 179/107 E |

*Primary Examiner*—G. Z. Rubinson
*Assistant Examiner*—L. C. Schroeder
*Attorney, Agent, or Firm*—Salter & Michaelson

[57] ABSTRACT

A hearing aid having an earplug that is inserted wholly within the auditory canal of the ear of a user to leave the concha portion of the user's ear exposed for the collection of sound waves for transmission to a microphone as located in the outermost end of the ear plug; the component parts of the hearing aid being wholly contained within the ear plug, thereby avoiding the use of the conventional exposed tubing, wiring and behind-the-ear housing which normally contains the hearing aid controls therein, and a cover member being pivotally mounted on the outer surface of the earplug for concealing the controls thereon and for effecting a smooth uninterrupted outer surface that is aesthetically pleasing as located in the user's ear.

7 Claims, 5 Drawing Figures

HEARING AID

BACKGROUND OF THE INVENTION

The present invention relates to a hearing aid that is of the type that includes a miniaturized ear plug for use therewith that has a shape and configuration that provides for the insertion thereof wholly within the auditory canal of the ear of the user, so that the concha portion of the user's ear is unobstructed and acts as a focal point for collecting sound and directing it into a microphone of the hearing aid as located in the ear plug thereof.

Hearing aid devices of the type that include a molded ear plug in which a microphone is located have been utilized heretofore as illustrated in applicant's prior U.S. Pat. No. 4,291,203. In applicant's prior U.S. Pat. No. 4,291,203, the microphone is innerconnected to an amplifier located in a housing mounted in close proximity to the user's ear. A transducer-receiver as disclosed in U.S. Pat. No. 4,291,203 is located in the housing in electrical communication with the amplifier and transmits the amplified sound to a sound tube that is secured in the ear plug and that also communicates with the auditory canal of the user's ear. Thus, in the prior know device, electrical means are utilized to receive sound waves for transfer to the amplifier, the amplified sound therafter being conventionally transmitted to a conventional receiver and sound tube for introduction into the auditory canal of the user. Although the prior known hearing aid device as illustrated in applicant's prior U.S. Pat. No. 4,291,203 was satisfactory for the purpose intended, it did require the use of external wiring and a sound tube that was interconnected to the behind-the-ear housing in which the controls for the hearing aid were located. Such externally visible components and wiring were not only unsightly and in some instances embarrassing to the user, but because of handling, the controls and wiring for the hearing aid sometimes became mechanically inoperative, and on occasion the quality of sound was not always satisfactory. The present invention avoids the use of the externally located components such as have been utilized heretofore in the behind-the-ear housing, and further avoids the use of extended electrical wiring or sound tubes. One of the unique features of the invention is in the use of a cover member that is pivotally mounted on the ear plug and essentially conceals the hearing aid battery and controls to define an unobstructed outer surface that is aesthetically ornamental and pleasing to the eye.

SUMMARY OF THE INVENTION

The present invention relates to a miniaturized hearing aid that includes an ear plug that is inserted directly into the auditory canal of the user and that contains all of the components of the hearing aid therein, thereby eliminating the use of external wiring and sound tubes and the behind the ear housing. Thus, the microphone, amplifier, battery, transducer-receiver, and sound tube and the wiring therefor are all wholly contained within the ear plug that defines the hearing aid of the subject invention, the ear plug being constructed and shaped so that it fits wholly within the auditory canal of the user, thereby allowing for exposure of the entire concha portion of the user's ear. The hearing aid battery and controls are located on an outer portion of the ear plug but the battery and controls are essentially concealed by a unique cover member that is pivotally mounted on the outer portion, the cover member further forming an ornamental unobstructed outer surface that is easily pivoted from a closed to an open position to provide access to the battery and to the hearing aid controls.

Accordingly, it is an object of the present invention to provide a hearing aid that includes an ear plug in which all of the controls of the hearing aid are located, the ear plug fitting wholly within the confines of the auditory canal of the user to leave the concha portion of the user's ear exposed for collecting the sound waves and transmitting them to a microphone as fixed in the ear plug, a pivotally movable cover member also being provided that essentially conceals the hearing aid battery and controls and that is easily movable from a closed to an open position for access to said battery and controls and that also is unobstructed to define a smooth ornamental outer surface for the hearing aid as inserted into the ear of the user.

Other objects, features and advantages of the invention shall become apparent as the description thereof proceeds when considered in connection with the accompanying illustrative drawings.

DESCRIPTION OF THE DRAWING

In the drawings which illustrate the best mode presently contemplated for carrying out the present invention.

DESCRIPTION OF THE INVENTION

Figure 1:
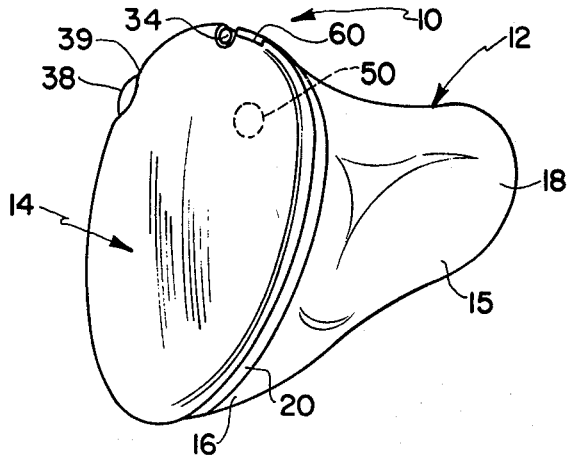
FIG. 1 is a front perspective view of the ear plug and cover member therefor as embodied in the subject invention.
Figure 2:
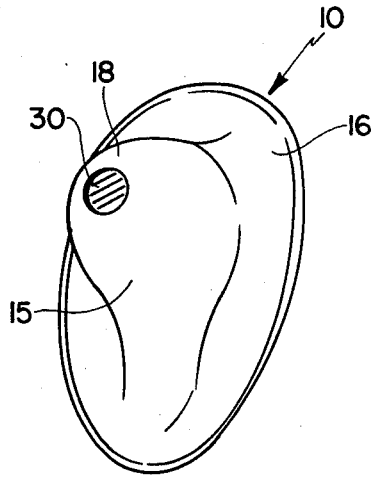
FIG. 2 is a rear perspective view thereof.

Referring now to the drawing, and particularly to FIGS. 1 and 2, the hearing aid embodied in the present invention is illustrated and is generally indicated at 10. The hearing aid 10 includes an ear plug generally indicated at 12 to which, as will hereinafter be described, a cover member generally indicated at 14 is pivotally connected.

As shown in the drawing, the ear plug 12 includes a body portion 15 that has a reducing tapered configuration from an enlarged outer end 16 of generally oval configuration to a reduced rounded inner end 18. The body portion 15 is preferably formed in a shell of a metallic material such as electroplated silver on which a gold plate is added that not only defines a hypoallergenic surface but also aids in improving the sound characteristics of the unit. The configuration of the body portion 15 is normally custom shaped to fit into the auditory canal of the user and is so constructed that the ear plug is contained substantially wholly within the auditory canal to leave the cover member 14 exposed and positioned adjacent to the concha portion of the user's ear. In this connection, the concha portion acts in the usual manner as a focal point to collect sound waves transmitted to the ear of the user for directing the sound into the auditory canal of the user's ear. As will be described, the sound is received by a microphone of the hearing aid that has access to the concha portion for effectively receiving the sound as collected therein.

Figure 4:
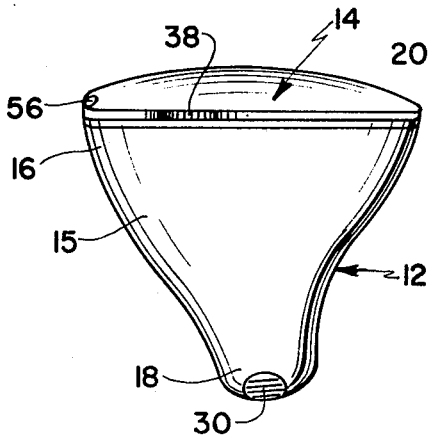
FIG. 4 is a side elevational view of the hearing aid ear plug and cover member.

One of the unique features of applicant's invention resides in the miniaturization of the component parts of the hearing aid which enables all of them to be contained within the ear plug 12, thereby avoiding the use of the conventional wiring, tubes and behind-the-ear housing that is normally associated with hearing aids known heretofore. As more clearly illustrated in FIG. 4, the ear plug 12 includes a top plate 20 that is secured to the top portion 16 of the body portion 15 and has an oval configuration that corresponds thereto. Located within the body portion 15 is an amplifier 22, of conventional construction, to which a transducer-receiver 24 is electrically connected by wiring. Mounted in the transducer-receiver is a sound tube 26 that projects outwardly therefrom toward the bottom end 18 of the body portion 15. The outermost end of the sound tube 26 terminates adjacent to an opening 28 that is formed in the rounded bottom end 18 of the body portion 15, and as shown in FIGS. 2 and 4, a grill 30 covers the opening 28 in protective relation.

Figure 3:
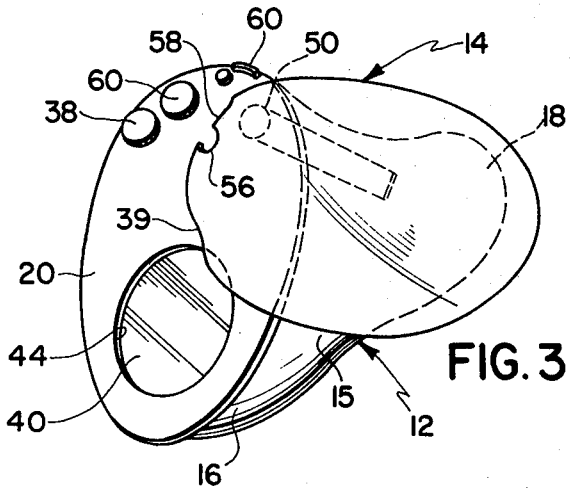
FIG. 3 is a perspective view similar to FIG. 1 and showing the cover plate therefor in the open position.

Mounted in the top plate 20 of the ear plug 12 and electrically connected to the amplifier 22 by suitable wiring is a microphone unit 32 from which a miniaturized microphone 34 projects upwardly therefrom. A volume control unit 36 is also mounted in the top plate 20 and is further electrically connected to the amplifier 22 by suitable wiring for controlling the volume of sound as transmitted to the sound tube 26. An adjustment rheostat control 38 is located on the volume control unit 36 and is adjustable by the user to effect the required volume of sound as transmitted to the sound tube 26. As shown in FIGS. 1, 3 and 4, the adjustment control 38 is positioned closely adjacent to the marginal edge of the top plate 20 and is aligned with a recess 39 as formed in the periphery of the cover member 14. The periphery of the control 38 is notched or knurled, a portion of which extends into the recess 39, thereby enabling the user to effect a finer adjustment in volume without the need to move the cover member 14 from the closed to an open position.

In order to provide the necessary electrical energy for the operation of the various components of the hearing aid, a conventional miniature battery 40 is utilized, and is received in a recess 42 as formed in the top plate 20. Fixed in the bottom wall of the recess is a contact plate 44 that is electrically connected to the amplifier 22 by way of a wire lead 46. In order to complete the circuit to the amplifier 22, a strip contact 48 is provided and is secured to the underside of the cover member 12 so that when the cover member is located in the closed position, the contact 48 engages the battery 40. The contact 48 is fixed in the cover plate 12 by a contact pin 50 that is pivotally secured in a terminal 52 that is also fixed in the top plate 20 of the ear plug 14. The terminal 52 is electrically connected to the amplifier 22 by a wire lead 54. It is seen that the cover member 12 is pivotally mounted on the top plate 20 of the ear plug 12 by the pin 50, the pin 50 cooperating with the contact 48 and the terminal 52 to complete the circuit to the battery 22 when the cover plate is located in the closed position thereof.

Figure 5:
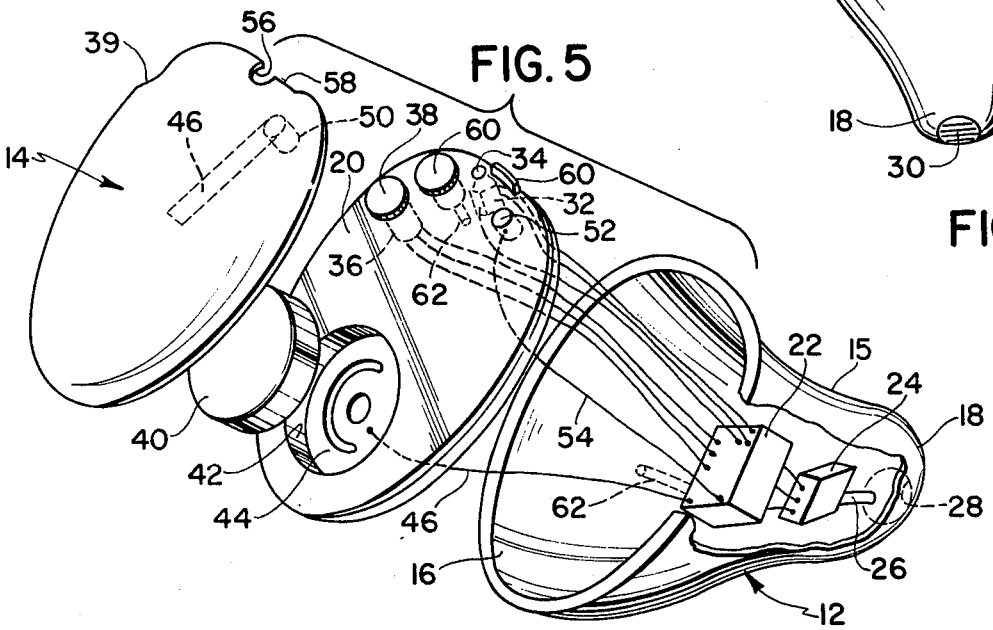
FIG. 5 is an exploded perspective view of the hearing aid illustrating the ear plug and pivoted cover member and further showing the hearing aid controls and the component parts that are obtained within the ear plug.

As described and as illustrated in FIG. 3, the cover member 12 is pivotally mounted on the top plate 20 by the pivot pin 50 that is pivotally engageable with the terminal 52. The oval configuration of the cover member corresponds to that of the top plate 20 and as shown in FIG. 4, the cover member 14 has a dome-like configuration that adds to the ornamental appearance thereof. Formed in cover member 14 adjacent to the microphone 34 is an opening 56 that is aligned with the microphone 34 when the cover member 12 is disposed in the closed position thereof, as shown in FIG. 1. With the microphone 34 externally exposed through the opening 56, it has communication with the concha portion of the user's ear for receiving sound waves therefrom. The cover member 12 is further formed with an indentation 58 in the margin or periphery thereof that is located adjacent to the opening 56, the indentation 58 being engagable with a projection 60 that is formed on the top plate 20 adjacent to the periphery thereof. The configuration of the recess 58 is such as to be received in nesting engagement with the projection 60, thereby locating the cover member 12 in a secure closed position. As further shown in FIGS. 3 and 5, a rotatable control member 62 is located on the top plate 20 and is interconnected to the amplifier 22 through a multiple lead wire 64. The control member 62 which is also conventional in operation is utilized to control the sound acoustical gain in accordance with the particular aural characteristics of the user.

In use, the hearing aid device is mounted in place by inserting the ear plug 12 into the auditory canal of the user's ear, leaving only the cover member 14 exposed. In the position of use, the microphone 34 has exterior exposure through the opening 56 formed in the cover member 14 and is located at the focal point in the concha portion of the user's ear, wherein sound waves directed to the chonca portion from an external source are transmitted directly to the microphone 34. The sound is then transmitted electrically to the amplifier 22 which amplifies the sound that is then converted by the transducer-receiver 24 for transmission by the sound tube 26 into the auditory canal of the user by way of the opening 28. The rheostat control 38 is easily accessable at the edge of the top plate 20 without moving the cover member from its closed position for controlling the volume of the device. With the device withdrawn from the user's ear the cover member 12 is pivoted to the open position as illustrated in FIG. 3 for access to the control member 62 and the battery 40. Thus the battery 40 is conveniently replaced upon the discharge thereof by simply moving the cover member 14 to the open position thereof thereby exposing the battery 40.

It is understood, that the components or instruments as located in the ear plug 12 of the subject invention are substantially conventional equipment as utilized in ear plugs, except to some extent they are miniaturized as provided for by available components of this type. However, the unique location of these components in the ear plug 12 and the accessability of the volume control and battery as provided for by the cover member 12 renders the device uniquely distinct in that the volume control is adjustable by a simple touch of the finger and the entire unit as located wholly within the comfines of the auditory canal of the user can be extracted therefrom as required for rendering other necessary adjustments or replacements. Further, the insertion of the ear plug entirely within the auditory canal of the user practically conceals the hearing aid so that it is substantially unnoticeable by others. The relatively unobstructed domed shape of the cover member 14 also provides the device with an ornamental and pleasing appearance and by forming the outer surface of the cover member with a flesh-like color, the unit is scarcely noticeable as inserted in the user's ear. Repairs and maintenance of the hearing aid are easily accomplished, since the cover member 12 and top plate 20 can be removed from their positions of use for exposing the interior of the body portion 12 and the components contained therein.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A hearing aid, comprising an ear plug for insertion wholly within the auditory canal of the ear of a user, said ear plug including a body portion that is formed with a generally tapering configuration that reduces from an enlarged outer generally oval portion to an inner end portion, said inner end portion having a generally rounded configuration that provides for easy insertion of said ear plug into the auditory canal, said ear plug being of a size and configuration that provides for insertion of substantially the entire body portion thereof into said auditory canal, wherein the concha portion of the user's ear is substantially exposed for receiving and collecting sound therein, a battery mounted in said body portion, microphone means mounted in said body portion and being exposed for receiving sound as collected by the concha portion of the user's ear, means located wholly within said body portion and electrically communicating with said microphone for amplifying the sound signals received by said microphone, a sound tube embedded in said body portion and communicating with said auditory canal and receiving said amplified sound for transmission to the auditory canal of the user, control means mounted on said outer portion for controlling the sound as transmitted to said tube, and a cover member pivotally secured to said ear plug for covering the outer portion of said body portion for concealing said control means and battery and defining a smooth unobstructed outer surface of said ear plug that is ornamentally pleasing as inserted into the auditory canal of the user.

2. A hearing aid as claimed in claim 1, said outer portion of said ear plug having a recess formed therein in which a battery is removably mounted, said battery being electrically interconnected to said amplifier for supplying electrical current thereto.

3. A hearing aid as claimed in claim 2, said cover member having an opening formed therein that is aligned with said microphone when said cover member is located in the normally closed position thereof to provide for exterior communication of said microphone and said concha portion.

4. A hearing aid as claimed in claim 3, a projection located on said outer portion adjacent to a marginal edge thereof, said cover member having a groove formed in the periphery thereof that is engageable with said projection for positively locating said cover member in the normally closed position thereof.

5. A hearing aid as claimed in claim 3, an electrical contact secured to the underside of said cover plate by a terminal fastener for locating said contact in engagement with a terminal of said battery, said terminal fastener engaging and being electrically connected to a complementary fastener located in said top portion, said complementary fastener being electrically connected to said amplifier and cooperating with said terminal fastener to form a pivot connection for said cover member on said outer portion.

6. A hearing aid as claimed in claim 3, mean electrically communicating with said amplifier for adjusting the volume of sound as amplified by said amplifier and transmitted to said sound tube, said adjusting means including a volume control member that is exteriorly accessible at the peripheral edge of said cover member.

7. A hearing aid as claimed in claim 6, a transducer-receiver located in said body portion adjacent to the reduced inner end thereof and electrically communicating with said amplifier for receiving sound signals therefrom, said transducer-receiver transmitting the amplified sound as received from said amplifier to said sound tube for transmission to said auditory canal.

* * * * *